US006681578B1

(12) United States Patent
Bunker

(10) Patent No.: US 6,681,578 B1
(45) Date of Patent: Jan. 27, 2004

(54) COMBUSTOR LINER WITH RING TURBULATORS AND RELATED METHOD

(75) Inventor: Ronald Scott Bunker, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/065,814

(22) Filed: Nov. 22, 2002

(51) Int. Cl.[7] ..... F02C 1/00
(52) U.S. Cl. ..... 60/772; 60/759; 60/772
(58) Field of Search ..... 60/752, 759, 760, 60/772

(56) References Cited

U.S. PATENT DOCUMENTS

| | | | | |
|---|---|---|---|---|
| 1,848,375 A | | 3/1932 | Muir | |
| 2,801,073 A | | 7/1957 | Savage | |
| 2,938,333 A | | 5/1960 | Wetzler | |
| 3,229,763 A | | 1/1966 | Rosenblad | |
| 3,572,031 A | | 3/1971 | Szetela | |
| 3,664,928 A | | 5/1972 | Roberts | |
| 3,899,882 A | * | 8/1975 | Parker | 60/39.65 |
| 4,158,949 A | * | 6/1979 | Reider | 60/39.32 |
| 4,184,326 A | * | 1/1980 | Pane, Jr. et al. | 60/39.32 |
| 4,688,310 A | * | 8/1987 | Kelm | 29/156.8 R |
| 4,838,031 A | * | 6/1989 | Cramer | 60/753 |
| 5,024,058 A | | 6/1991 | Shekleton et al. | |
| 5,329,773 A | * | 7/1994 | Myers et al. | 60/759 |
| 5,353,865 A | * | 10/1994 | Adiutori et al. | 165/133 |
| 5,361,828 A | | 11/1994 | Lee et al. | |
| 5,363,654 A | | 11/1994 | Lee | |
| 5,419,039 A | | 5/1995 | Auxier et al. | |
| 5,421,158 A | | 6/1995 | Stenger et al. | |
| 5,460,002 A | * | 10/1995 | Correa | 60/723 |
| 5,651,662 A | | 7/1997 | Lee et al. | |
| 5,660,525 A | | 8/1997 | Lee et al. | |
| 5,681,144 A | | 10/1997 | Spring et al. | |
| 5,695,321 A | | 12/1997 | Kercher | |
| 5,724,816 A | | 3/1998 | Ritter et al. | |
| 5,738,493 A | | 4/1998 | Lee et al. | |
| 5,758,503 A | * | 6/1998 | Dubell et al. | 60/752 |
| 5,797,726 A | | 8/1998 | Lee | |
| 5,822,853 A | | 10/1998 | Ritter et al. | |
| 5,933,699 A | | 8/1999 | Ritter et al. | |
| 5,975,850 A | | 11/1999 | Abuaf et al. | |

(List continued on next page.)

FOREIGN PATENT DOCUMENTS

| | | | |
|---|---|---|---|
| JP | 61-280390 | | 12/1986 |
| JP | 408110012 A | * | 4/1996 |
| JP | 9-2176994 | | 8/1997 |
| JP | 2001-164901 | | 6/2001 |

OTHER PUBLICATIONS

"Corporate Research and Development Technical Report Abstract Page and Sections 1–2," Bunker et al., Oct. 2001.

"Corporate Research and Development Technical Report Section 3," Bunker et al., Oct. 2001.

"Thermohydraulics of Flow Over Isolated Depressions (Pits, Grooves) in a Smooth Wall," Afanas'yev et al., Heat Transfer Research, vol. 25, No. 1, 1993.

(List continued on next page.)

*Primary Examiner*—Justine R. Yu
*Assistant Examiner*—John Belena
(74) *Attorney, Agent, or Firm*—Nixon & Vanderhye P.C.

(57) ABSTRACT

A combustor liner for a gas turbine includes a substantially cylindrical body having a plurality of raised circular ribs arranged in an array on an outside surface of the combustor liner, each rib defining an enclosed are on the outside surface of the liner, forming a dimple or bowl that is sufficient to form vortices for fluid mixing in order to bring about heat transfer enhancement by both turbulated effect and dimpled effect.

18 Claims, 4 Drawing Sheets

U.S. PATENT DOCUMENTS

| | | | | | |
|---|---|---|---|---|---|
| 6,098,397 | A | | 8/2000 | Glezer et al. | |
| 6,134,877 | A | * | 10/2000 | Alkabie | 60/748 |
| 6,190,120 | B1 | | 2/2001 | Thatcher et al. | |
| 6,237,344 | B1 | * | 5/2001 | Lee | 60/754 |
| 6,314,716 | B1 | | 11/2001 | Abreu et al. | |
| 6,334,310 | B1 | | 1/2002 | Sutcu et al. | |
| 6,402,464 | B1 | | 6/2002 | Chiu et al. | |
| 6,408,629 | B1 | | 6/2002 | Harris et al. | |
| 6,412,268 | B1 | | 7/2002 | Cromer et al. | |
| 6,468,669 | B1 | * | 10/2002 | Hasz et al. | 428/553 |
| 6,494,044 | B1 | | 12/2002 | Bland | |
| 6,504,274 | B2 | | 1/2003 | Bunker et al. | |
| 6,526,756 | B2 | * | 3/2003 | Johnson et al. | 60/772 |
| 2001/0052411 | A1 | | 12/2001 | Pantow et al | |

OTHER PUBLICATIONS

Mass/Heat Transfer in Rotating Dimpled Turbine–Blade Coolant Passages, Charya et al., Louisiana St. University, 2000.

"Effect of Surface Curvature on Heat Transfer and Hydrodynamics within a Single Hemispherical Dimple," Proceedings of ASME TURBOEXPO 2000, May 8–11, 2000, Munich Germany.

"Concavity Enhanced Heat Transfer in an Internal Cooling Passage," Chyu et al., presented at the International Gas Turbine & Aeroengine Congress & Exhibition, Orlando, Florida, Jun. 2–5, 1997.

"Heat Transfer Augmentation Using Surfaces Formed by a System of Spherical Cavities," Belen'kiy et al., Heat Transfer Research, vol. 25, No. 2, 1993.

"Experimental Study of the Thermal and Hydraulic Characteristics of Heat–Transfer Surfaces Formed by Spherical Cavities," Institute of High Temperatures, Academy of Sciences of the USSR. Original article submitted Nov. 28, 1990.

"Turbulent Flow Friction and Heat Transfer Characteristics for Spherical Cavities on a Flat Plate," Afanasyev et al., Experimental Thermal and Fluid Science, 1993.

"Convective Heat Transfer in Turbulized Flow Past a Hemispherical Cavity," Heat Transfer Research, vol. 25, Nos. 2, 1993.

Patent application Ser. No. 10/010,549, filed Nov. 8, 2001.

Patent application Ser. No. 10/063,467, filed Apr. 25, 2002.

Patent application Ser. No. 10/162,755, filed Jun. 6, 2002.

Patent application Ser. No. 10/162,756, filed Jun. 6, 2002.

Patent application Ser. No. 10/064,605, filed Jul. 30, 2002.

Patent application Ser. No. 10/065,108, filed Sep. 18, 2002.

Patent application Ser. No. 10/065,115, filed Sep. 18, 2002.

Patent application Ser. No. 10/065,495, filed Oct. 24, 2002.

Patent application Ser. No. 10/301,672, filed Nov. 22, 2002.

* cited by examiner

COMBUSTOR LINER WITH RING TURBULATORS AND RELATED METHOD

BACKGROUND OF THE INVENTION

This invention relates generally to turbine components and more particularly to a combustor liner that surrounds the combustor in land based gas turbines having can annular combustion systems.

Traditional gas turbine combustors use diffusion (i.e., non-premixed) combustion in which fuel and air enter the combustion chamber separately. The process of mixing and burning produces flame temperatures exceeding 3900 degrees F. Since conventional combustors and/or transition pieces having liners are generally capable of withstanding for about ten thousand hours (10,000 hrs.), a maximum temperature on the order of only about 1500 degrees F., steps to protect the combustor and/or transition piece must be taken. This has typically been done by film-cooling which involves introducing relatively cool compressor air into a plenum formed by the combustor liner surrounding the outside of the combustor. In this prior arrangement, the air from the plenum passes through louvers in the combustor liner and then passes as a film over the inner surface of the liner, thereby maintaining combustor liner integrity.

Because diatomic nitrogen rapidly disassociates at temperatures exceeding about 3000° F. (about 1650° C.), the high temperatures of diffusion combustion result in relatively large NOx emissions. One approach to reducing NOx emissions has been to premix the maximum possible amount of compressor air with fuel. The resulting lean premixed combustion produces cooler flame temperatures and thus lower NOx emissions. Although lean premixed combustion is cooler than diffusion combustion, the flame temperature is still too hot for prior conventional combustor components to withstand.

Furthermore, because the advanced combustors premix the maximum possible amount of air with the fuel for NOx reduction, little or no cooling air is available, making film-cooling of the combustor liner and transition piece premature at best. Nevertheless, combustor liners require active cooling to maintain material temperatures below limits. In dry low NOx (DLN) emission systems, this cooling can only be supplied as cold side convection. Such cooling must be performed within the requirements of thermal gradients and pressure loss. Thus, means such as thermal barrier coatings in conjunction with "backside" cooling have been considered to protect the combustor liner and transition piece from destruction by such high heat. Backside cooling involved passing the compressor air over the outer surface of the combustor liner and transition piece prior to premixing the air with the fuel.

With respect to the combustor liner, one current practice is to impingement cool the liner, or to provide linear turbulators on the exterior surface of the liner. Another more recent practice is to provide an array of concavities on the exterior or outside surface of the liner (see U.S. Pat. No. 6,098,397). The various known techniques enhance heat transfer but with varying effects on thermal gradients and pressure losses. Turbulation strips work by providing a blunt body in the flow which disrupts the flow creating shear layers and high turbulence to enhance heat transfer on the surface. Dimple concavities function by providing organized vortices that enhance flow mixing and scrub the surface to improve heat transfer.

There remains a need for enhanced levels of active cooling with minimal pressure losses and for a capability to arrange enhancements as required locally.

SUMMARY OF INVENTION

This invention provides convection cooling for a combustor liner by means of cold side (i.e., outside) surface features that result in reduced pressure loss.

In the exemplary embodiment of this invention, discrete ring turbulators are provided on the cold side of the combustor liner, each ring defined by a circular raised tubular shaped rib enclosing an interior area or hollow interior region. The ring turbulators are preferably provided as a uniform staggered array over substantially the entire cold side surface of the liner. In one arrangement, the ribs have a square cross-section, but the cross-sectional shape may vary to include, for example, rectangular and tapered inside and/or outside edge surfaces. The edge surfaces may also vary about the periphery of the ring, dependent on the direction of cooling air flow. In addition, the inside and outside corners of the ribs may be sharp or smooth. Ring type turbulators maintain many of the positive effects of known linear turbulators, but the rounded shape and the "concave" areas enclosed by the ring will produce lower pressure loss. The round shape of the turbulators still disrupts the flow, but does so in a manner which is more distributed, especially if the rings are patterned in a staggered fashion. At the same time, the "dimple" or "bowl" shaped interiors form the vortices for fluid mixing. Thus, heat transfer enhancement is by both turbulated effect and dimpled effect.

The height and width of the ribs may also vary, and the "floor" of the enclosed area may be raised above the outer non-ring surface area of the liner.

Accordingly, in its broader aspects, the invention relates to a combustor liner for a gas turbine comprising a substantially cylindrical body having a plurality of raised ribs arranged on an outside surface of the combustor liner, each rib defining an enclosed area on said outside surface.

In another aspect, the invention relates to a combustor liner for a gas turbine comprising a substantially cylindrical body having a plurality of raised circular turbulator rings arranged on an outside surface of the combustor liner; and wherein the rings have height and width dimensions of between about 0.020 and 0.120 inches and inside diameters of between 2 and 5 times the height dimension.

In still another aspect, the invention relates to a method of cooling a combustor liner in a gas turbine combustor comprising establishing a flow path for compressor discharge air along an outer surface of combustor liner; and forming a plurality of discrete ring turbulators on the outer surface of the combustor to enhance heat transfer, each ring turbulator comprising a raised peripheral rib of substantially round or oval shape.

The invention will now be described in detail in conjunction with the following drawings.

DETAILED DESCRIPTION

Figure 1:
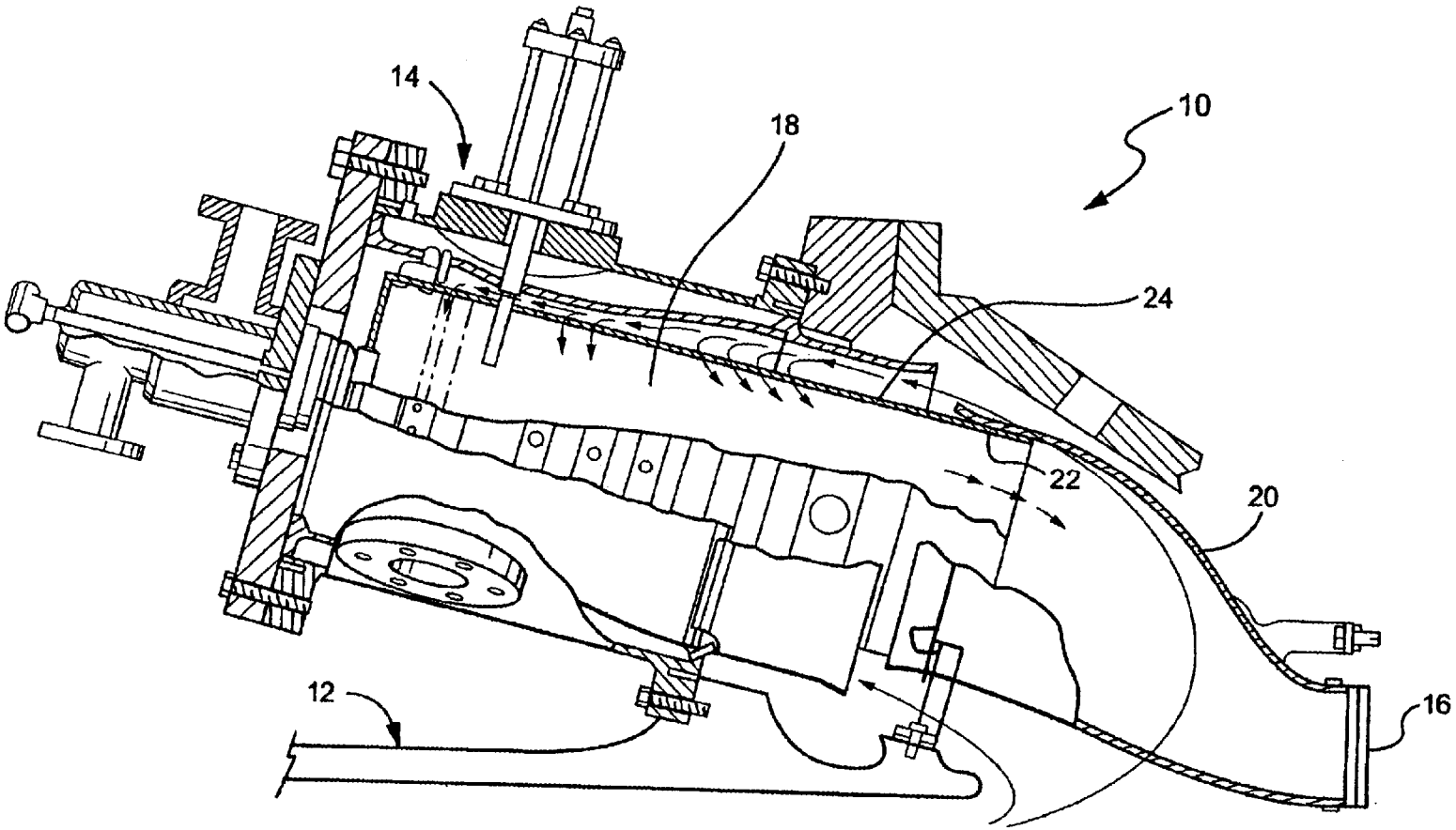
Fig. 1 (Prior Art)
FIG. 1 is a schematic representation of a known gas turbine combustor.

FIG. 1 schematically illustrates a typical can annular reverse-flow combustor 10 driven by the combustion gases from a fuel where a flowing medium with a high energy content, i.e., the combustion gases, produces a rotary motion as a result of being deflected by rings of blading mounted on a rotor. In operation, discharge air from the compressor 12 (compressed to a pressure on the order of about 250–400 $lb/in^2$) reverses direction as it passes over the outside of the combustors (one shown at 14) and again as it enters the combustor en route to the turbine (first stage indicated at 16). Compressed air and fuel are burned in the combustion chamber 18, producing gases with a temperature of about 1500° C. or about 2730° F. These combustion gases flow at a high velocity into turbine section 16 via transition piece 20. The transition piece connects to the combustor liner 24 at 22, but in some applications, a discrete connector segment may be located between the transition piece 20 and the combustor liner.

In the construction of combustors and transition pieces, where the temperature of the combustion gases is about or exceeds about 1500° C., there are known materials which can survive such a high intensity heat environment without some form of cooling, but only for limited periods of time. Such materials are also expensive.

Figure 2:
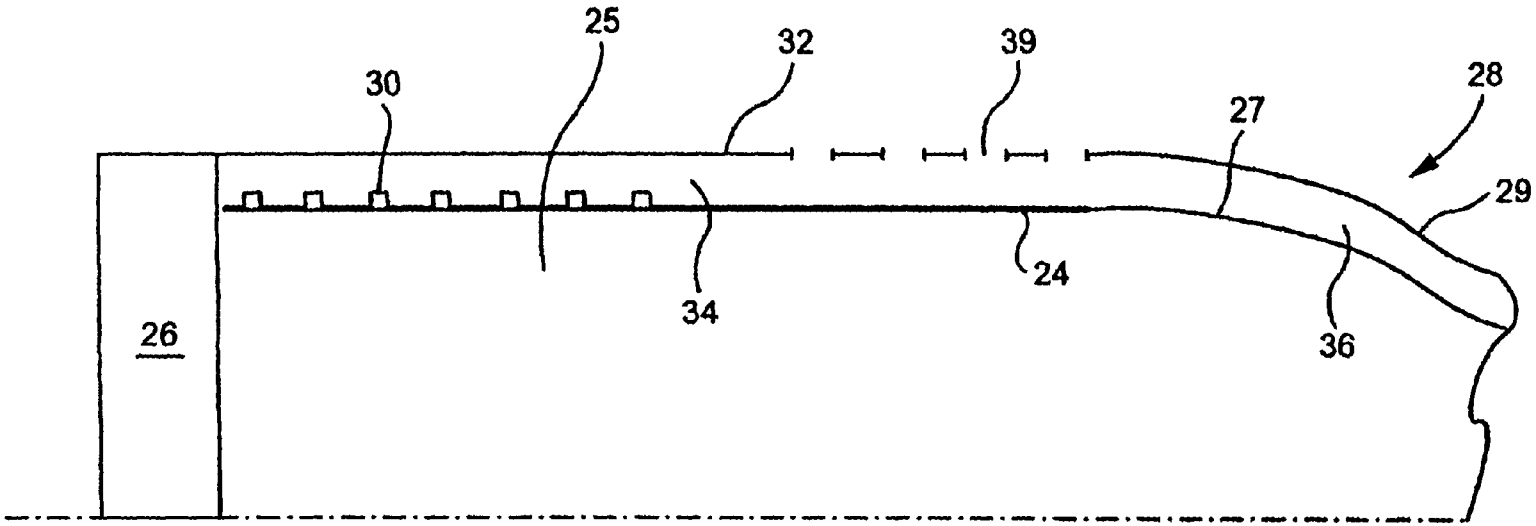
Fig. 2 (Prior Art)
FIG. 2 is a schematic view of a cylindrical combustor liner with linear turbulators.

FIG. 2 shows in schematic form a generally cylindrical combustor liner 24 of conventional construction, forming a combustion chamber 25. The combustor liner 24 has a combustor head end 26 to which the combustors (not shown) are attached, and an opposite or forward end to which a transition piece assembly 28 is attached. The transition piece assembly includes the transition piece 27 and a surrounding sleeve 29. The transition piece assembly 28 may be connected to the combustor liner 24 and its respective flow sleeve 32 by connecting double-wall segments (not shown).

The combustor liner 24 is provided with a plurality of upstanding, annular (or part-annular) ribs or turbulators 30 in a region adjacent the head end 26. These ribs are elongated or "linear" in shape, arranged transversely to the direction of cooling air flow. A cylindrical flow sleeve 32 surrounds the combustor liner in radially spaced relationship, forming a plenum 34 between the liner and flow sleeve that communicates with a plenum 36 formed by the transition piece 27 and its own surrounding flow sleeve 29. Impingement cooling holes or apertures 39 are provided in the flow sleeve 32 in a region axially between the transition piece assembly 28 and the turbulators 30 in the liner 24.

Figure 3:
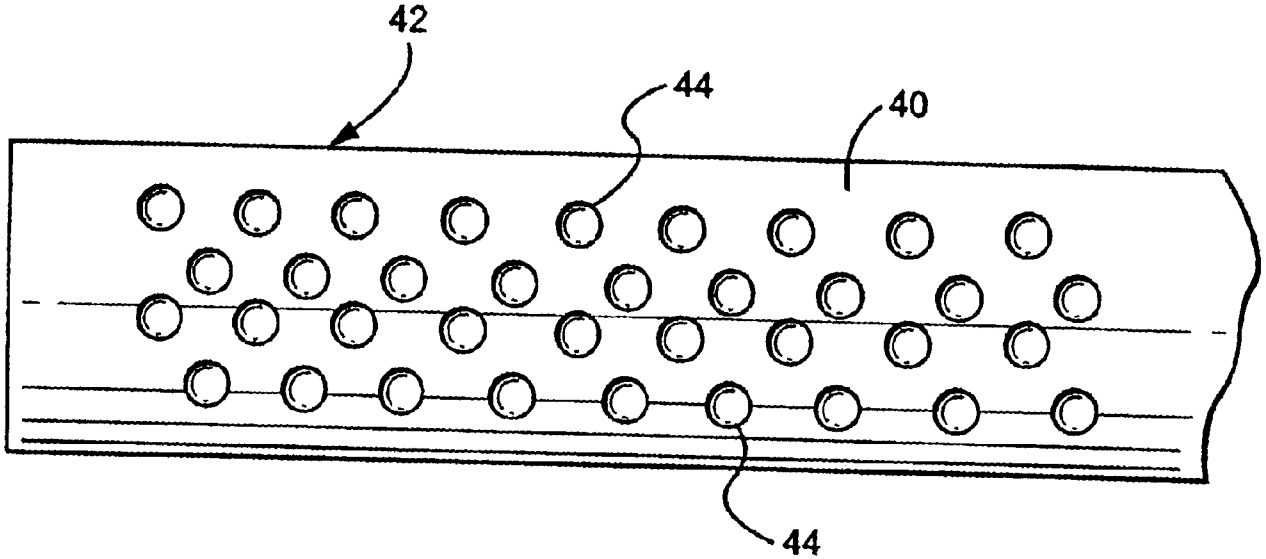
Fig. 3 (Prior Art)
FIG. 3 is a schematic view of a known cylindrical combustor liner with an array of concavities on the exterior surface thereof.

FIG. 3 illustrates in schematic form another known heat enhancement technique. In this instance, the exterior surface 40 of the combustor liner 42 is formed over an extended area thereof with a plurality of circular concavities or dimples 44 (see U.S. Pat. No. 6,098,397).

Figure 4:
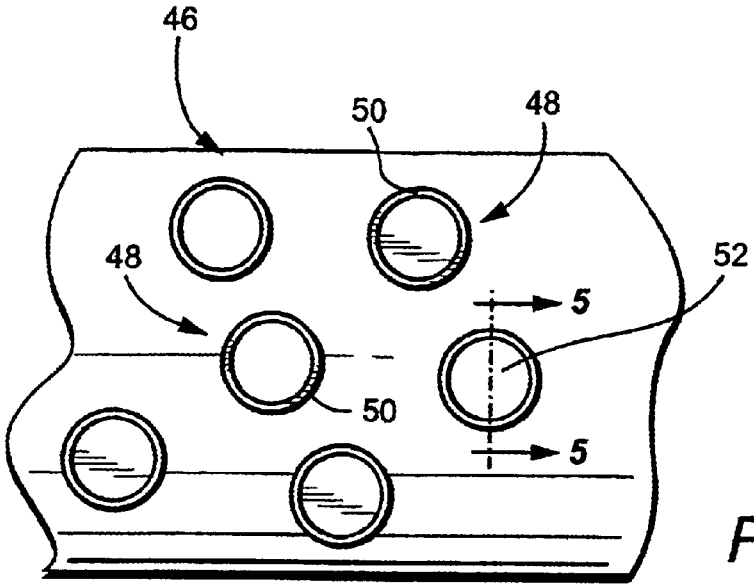
FIG. 4 is a schematic side elevation view of a cylindrical combustor liner with discrete ring turbulators in accordance with the invention.

Turning to FIG. 4, a combustor liner 46 in accordance with an exemplary embodiment of this invention is formed with a plurality of circular ring turbulators 48. Each ring turbulator 48 comprises a discrete or individual circular ring defined by a raised peripheral rib 50 that creates an enclosed area 52 within the ring. The ring turbulators are preferably arranged in an orderly staggered array axially along the length of the liner 46 with the rings located on the cold side surface of the liner, facing radially outwardly toward a surrounding flow sleeve (not shown but similar to flow sleeve 32 in FIG. 2). The ring turbulators may also be arranged randomly (or patterned in a non-uniform but geometric manner) but generally uniformly across the surface of the liner.

Figure 5:
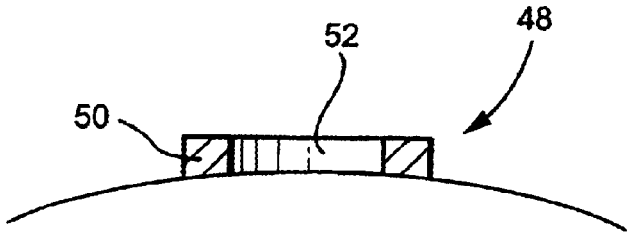
FIG. 5 is a cross-section taken along the line 5—5 of FIG. 4.
Figure 6:
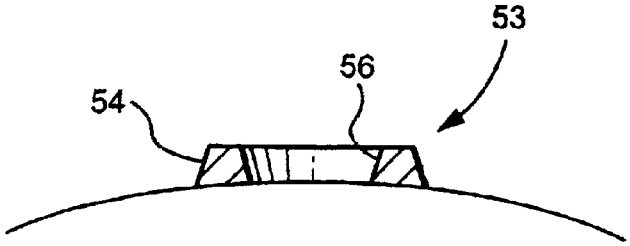
FIG. 6 is a cross-section through a ring turbulator in accordance with another embodiment of the invention.
Figure 7:
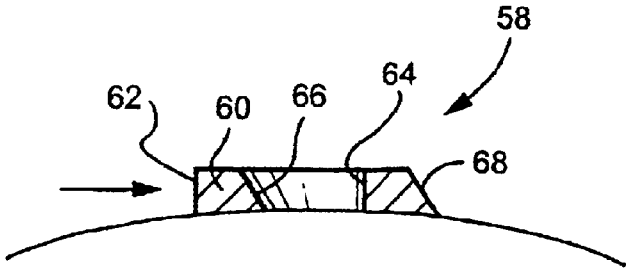
FIG. 7 is a cross-section through a ring turbulator in accordance with still another embodiment of the invention.

As best seen in FIG. 5, the rib 50 is substantially square in cross-section. FIG. 6 illustrates an alternative cross-section for a ring turbulator 53 where the inside edge surface 56 and outside edge surface 54 are tapered. In FIG. 7, the ring turbulator 58 is formed with a raised rib 60, the cross-sectional shape of which varies about the circumference thereof. More specifically, those edge portions 62, 64 that face the cooling flow (indicated by the flow arrows) are blunt, while on the trailing side, the inside and outside edge surfaces 66, 68 are tapered. If desired, this arrangement may be reversed with the blunt edges away from the flow direction, resulting in lower pressure losses. In addition, the edges and the lower corners can each or all be rounded/fillets if desired.

In presently preferred configurations, the height and width of the ring turbulators range from about 0.020 to 0.120 inches. The inner diameter of each ring turbulator is related to height, and is no more than 5 times the height and no less than 2 times the height. In addition, the "floor" within the round enclosure formed by the raised rib may be raised relative to the liner surface outside the ring turbulator. While circular ring turbulators are illustrated in FIGS. 4–7, it will be appreciated that the turbulators may be oval or other suitable shapes, recognizing that the dimensions and shape must establish an inner dimple or bowl that is sufficient to form vortices for fluid mixing. The combined enhancement aspects of turbulation and vortex mixing serve to improve heat transfer and thermal uniformity, and result in lower pressure loss than conventional turbulators.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A combustor liner for a gas turbine comprising a substantially cylindrical body having a plurality of discrete, ring turbulators on an outside surface of said combustor liner, and arranged in an array about the circumference of said combustor liner, said ring turbulators comprising respective circular or oval raised ribs, each rib extending radially from said outside surface and defining a hollow interior region within said rib that is closed at one end by said outside surface of said combustor liner, said hollow interior regions adapted to create vortices in cooling air flowing across said outside surface of said combustor liner.

2. The combustor liner of claim 1 wherein said ribs are substantially square in cross-section.

3. The combustor liner of claim 1 wherein said ribs have inside and outside edge surfaces that are tapered.

4. The combustor liner of claim 1 wherein said ribs vary in cross-section about the circumference thereof.

5. A combustor liner for a gas turbine comprising a substantially cylindrical body having a plurality of raised radially extending ribs arranged on an outside surface of said combustor liner, each rib defining a hollow region within said rib that is closed at one end by said outside surface of said combustor liner; wherein said ribs each have a height of between about 0.020 and 0.120 inches.

6. A combustor liner for a gas turbine comprising a substantially cylindrical body having a plurality of raised radially extending tubular shaped ribs arranged on an outside surface of said combustor liner, each rib defining a hollow region within said rib that is closed at one end by said outside surface of said combustor liner; wherein said ribs have a width of between about 0.020 and 0.120 inches.

7. A combustor liner for a gas turbine comprising a substantially cylindrical body having a plurality of raised radially extending tubular shaped ribs arranged on an outside surface of said combustor liner, each rib defining a round hollow region within said rib that is closed at one end by said outside surface of said combustor liner; wherein said ribs have inside diameters between 2 and 5 times a height dimension of said ribs.

8. A combustor liner for a gas turbine comprising a substantially cylindrical body having a plurality of raised radially extending tubular ribs arranged on an outside surface of said combustor liner, each rib defining a round hollow region within said rib that is closed at one end by said outside surface of said combustor liner; wherein said ribs have height and width dimensions between about 0.020 and 0.120 inches and an inside diameter between 2 and 5 times a height dimension of said ribs.

9. The combustor liner of claim 1 wherein said ribs are arranged in a staggered array on said outside surface.

10. The combustor liner of claim 1 wherein said cylindrical body is enclosed within a substantially cylindrically shaped flow sleeve.

11. A combustor liner for a gas turbine comprising a substantially cylindrical body having a plurality of radially extending tubular shaped circular turbulator rings arranged on an outside surface of said combustor liner; and wherein said rings have height and width dimensions of between 0.020 and 0.120 inches and inside diameters of between 2 and 5 times the height dimension.

12. The combustor liner of claim 11 wherein said ribs are substantially square in cross-section.

13. The combustor liner of claim 11 wherein said ribs have inside and outside edge surfaces that are tapered.

14. The combustor liner of claim 11 wherein said ribs vary in cross-section about the circumference thereof.

15. The combustor liner of claim 11 wherein said cylindrical body is enclosed within a substantially cylindrically shaped flow sleeve.

16. The combustor liner of claim 15 wherein said flow sleeve is formed with a plurality of apertures therein.

17. A method of cooling a combustor liner in a gas turbine combustor comprising: establishing a flow path for compressor discharge air along an outer surface of said combustor liner; and forming a plurality of discrete ring turbulators arranged in spaced relationship on said outer surface of said combustor to enhance heat transfer, each ring turbulator comprising a raised rib in planform view of substantially round or oval shape extending radially from said outer surface, defining a hollow region within said rib that is closed at one end by said outside surface of said combustor liner, said hollow regions adapted to create vortices in cooling air flowing across said outside surface of said combustor liner.

18. The method of claim 17 and further comprising:

surrounding the combustor liner with an impingement flow sleeve provided with a plurality of cooling apertures to thereby form a plenum defining said flow path.

* * * * *